US006674249B1

(12) United States Patent
Leskovec

(10) Patent No.: US 6,674,249 B1
(45) Date of Patent: Jan. 6, 2004

(54) RESISTIVELY BALLASTED GASEOUS DISCHARGE LAMP CIRCUIT AND METHOD

(75) Inventor: Robert A. Leskovec, Cleveland, OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 09/695,257

(22) Filed: Oct. 25, 2000

(51) Int. Cl.[7] ..... H05B 37/00

(52) U.S. Cl. ..... 315/289; 315/290; 315/247; 315/291; 315/DIG. 5

(58) Field of Search ..... 315/58, 61, 62, 315/49, 66, 205, 209 R, 289, 290, DIG. 5, 247, 92, 276, 287, 291

(56) References Cited

U.S. PATENT DOCUMENTS 4,278,916 A * 7/1981 Regan et al. ..... 315/92
4,340,843 A * 7/1982 Anderson ..... 315/205
4,350,930 A * 9/1982 Peil et al. ..... 315/49
4,358,717 A * 11/1982 Elliott ..... 315/308
4,382,210 A * 5/1983 Buhrer ..... 315/73
4,392,081 A * 7/1983 Brown et al. ..... 315/46
4,398,130 A * 8/1983 McFadyen et al. ..... 315/226
4,399,392 A * 8/1983 Buhrer ..... 315/308
4,464,607 A * 8/1984 Peil et al. ..... 315/209 R
4,471,268 A * 9/1984 Brown et al. ..... 315/178
4,555,647 A * 11/1985 Leskovec et al. ..... 315/179
4,709,188 A * 11/1987 Roberts ..... 315/178
4,992,705 A * 2/1991 Hathaway, II ..... 315/324
5,146,139 A * 9/1992 Nilssen ..... 315/205
5,589,740 A * 12/1996 Rudolph et al. ..... 315/291
5,677,602 A * 10/1997 Paul et al. ..... 315/224
5,896,013 A * 4/1999 Leskovec ..... 315/171

* cited by examiner

*Primary Examiner*—Haissa Philogene
(74) *Attorney, Agent, or Firm*—Duane Morris, LLP

(57) ABSTRACT

A circuit and method for running a metal halide arc discharge lamp from an AC power source. The circuit includes a rectifier for producing a DC voltage. The lamp is resistively ballasted by a current limiting filament connected in series with the lamp. The circuit includes a switch that closes during start up of the lamp so that the resistive filament is energized to provide immediate light prior to the lamp entering the normal run mode.

22 Claims, 12 Drawing Sheets

RESISTIVELY BALLASTED GASEOUS DISCHARGE LAMP CIRCUIT AND METHOD

BACKGROUND OF THE INVENTION

The present invention is directed to gaseous discharge lamps. More particularly, the invention is directed to resistively ballasted gaseous discharge lamp operating circuits and methods of operation.

A gaseous discharge lamp, e.g., a metal halide gaseous discharge lamp, may be characterized as having three modes of operation, i.e., an initial high voltage breakdown mode, a glow-to-arc transition mode, and a steady state run mode. The typical circuit operating the lamp provides about 2–4 kilovolts to achieve initial breakdown in the lamp and then sufficient "open circuit voltage" (OCV) to effect a glow-to-arc transition in the lamp and stabilize the lamp in a steady state run mode.

Metal halide gaseous discharge lamps are typically constructed to run from direct current (DC) in order to give more consistent light and color rendition. To operate such lamps from standard 120 volt alternating current (AC) power sources it is necessary to rectify the AC power source to supply direct current to the lamp. The lamps are typically designed to operate at a certain fixed voltage across the lamp terminals and are biased to operate at a specific wattage by controlling the current that passes through the lamp. Gaseous-discharge lamp circuits must include a means for limiting the current through the lamp.

Some conventional circuits use an ordinary resistor to limit the current through the lamp. Other circuits include an incandescent lamp filament to provide resistance. In such circuits, the resistance of the lamp filament increases as the current through the lamp increases, thereby opposing the increase in current through the lamp. As a result, the resistive lamp filament maintains the overall current through the lamp approximately constant. The characteristics of the current limiting filament lamp are selected to provide the proper operating current for the arc discharge lamp.

The basic lamp running circuit includes a DC arc discharge lamp connected in series with an incandescent filament lamp. The arc discharge lamp is powered by DC provided to the lamp by rectifying the standard 120 volt AC supplied to the circuit from the AC power source. In addition to meeting the specifications for running the lamp in the steady state run mode, the lamp operating circuit must also provide for the other two transient modes of operation (i.e. the initial high voltage breakdown mode and the glow-to-arc transition mode).

The voltage obtained by using a typical full-wave bridge-rectifier configuration and a capacitor or storage filter operating from 120 volt AC is sufficient to operate the lamp in the steady state run mode. However, the rectified voltage is less than the OCV required to effect a glow-to-arc transistion in the lamp. Therefore, the rectified voltage (i.e., the DC line voltage) must be temporarily boosted during lamp startup to effect the glow-to-arc transition. Once the lamp is in the run mode, the lamp develops a terminal voltage that is less than the DC line voltage. Thus a current limiting means, such as an incandescent lamp filament, is placed in series with the rectified power source and the gaseous discharge lamp to maintain the lamp in a steady state run mode at the terminal voltage of the lamp.

The OCV required to effect the glow-to-arc transition in the lamp may be provided by a voltage doubler. Conventional DC lamp operating circuits include voltage doublers to boost the voltage during the lamp starting process. However, in these operating circuits the voltage doubler remains in operation during the steady state run mode of the lamp resulting in wasted energy, i.e. excess energy must be dissipated in the filament lamp during the run mode. In addition, conventional voltage doublers are by necessity "half-wave" and, therefore, require a larger filter capacitor to eliminate the "ripple" effects which cause lamp flicker.

Many prior art lamp operating circuits include complex electronic circuits to control the lamp current. This type of electronic ballast provides greater efficiency than ballasts including a lamp filament as a current limiter. However, this type of electronic ballast typically includes several high-frequency magnetic components in the form of inductors, transformers and other ferrite-core devices. As a result, the electronic ballast is expensive and also generates electromagnetic interference requiring the use of filters to meet FCC standards.

A filament ballast is less complex and thus less expensive than an electronic ballast. A filament ballasted lighting unit may be produced for about ten percent of the cost of a comparable unit with an electronic ballast. The filament ballasted lamp produces negligible electromagnetic interference (EMI) during the run mode, and only a minimal amount of interference during lamp startup. As a result, there is no need to use EMI filters.

However, the economy of a filament ballasted lamp may be further improved by simplifying the circuit and making multiple use of components to improve the overall efficiency of the filament ballasted lamp circuit.

Accordingly, it is an object of the present invention to provide a novel and improved gaseous discharge lamp operating circuit and method.

It is another object of the present invention to provide a novel arc discharge lamp operating circuit and method including a current-limiting lamp filament.

It is still another object of the present invention to provide a novel arc discharge lamp operating circuit and method for doubling the voltage of the DC line voltage to effect an arc condition in the lamp.

It is yet another object of the present invention to provide novel arc discharge lamp operating circuits and methods for providing immediate light during startup of the lamp.

It is another object of the present invention to provide a novel arc discharge lamp operating circuit and method wherein an incandescent lamp filament is illuminated only during a half-cycle of the AC power source during startup of the arc lamp.

It is another object of the present invention to provide a novel arc discharge lamp operating circuit and method for doubling the DC line voltage of the circuit and isolating a rectifier bridge storage capacitor from the DC voltage applied to the lamp to establish an arc condition during lamp startup.

It is yet a further object of the present invention to provide a novel method of operating an arc discharge lamp circuit with a bridge rectifier and storage capacitor that includes isolating the storage capacitor from the voltage required to cause the lamp to pass through the glow-to-arc transition mode.

It is a further object of the present invention to provide a novel circuit and method for operating an arc discharge lamp powered by a three phase AC power source that eliminates the need for a storage capacitor.

It is still a further object of the present invention to provide a novel method of operating an arc discharge lamp by resistively ballasting the lamp during the steady state mode with an incandescent lamp filament which also illuminates during startup of the arc discharge lamp.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
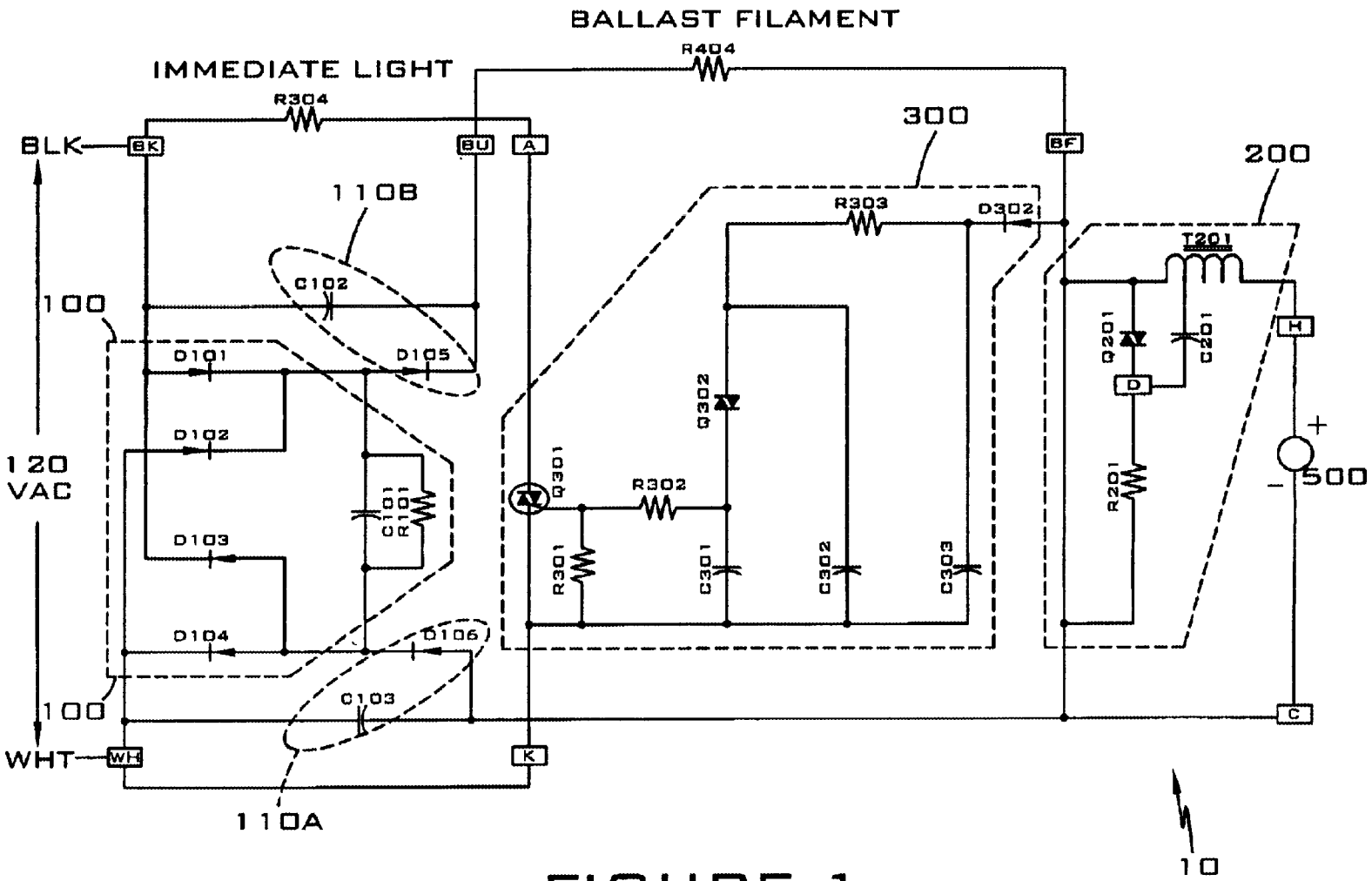
FIG. 1 is a schematic circuit diagram of one embodiment of a resistively ballasted metal halide arc discharge lamp circuit according to the present invention.

With reference to FIG. 1, the present invention is directed to a metal halide lamp operating circuit 10 including a resistive filament R404 in series with a metal halide DC arc discharge lamp 500 operating from a full-wave bridge rectifier 100 with a capacitor filter C101. The circuit 10 may be powered by a nominal 120 volt 50–60 Hz. AC power source and may include a negative-side voltage doubler 110A and a positive-side voltage doubler 110B to provide the OCV required during startup of the lamp 500.

The circuit 10 includes a conventional relaxation-type starter circuit 200 that may comprise a sidac Q201, capacitors C201, C202, charging resistor R201, and ferrite-core pulse transformer T201. The ferrite-core pulse transformer T201 must accommodate the DC lamp run current that passes through it and also provide inductance and resistance that is sufficiently low so as not to impede impulse currents that flow during the starting process.

Once the lamp 500 is warmed up and operating in a stable arc mode, i.e. the steady state run mode, the voltage breakover device Q201 (e.g. the sidac) in the relaxation starter circuit 200 assumes a non-conductive state and disconnects the components of the starter circuit 200 from the lamp circuit. As a result, the running lamp circuit comprises only the arc discharge lamp 500 and the series current limiting or ballast filament R404, thereby eliminating electromagnetic interference that results from ferrite core switching components.

FIG. 1 shows one embodiment of a ballast circuit according to the present invention. A bridge rectifier 100 comprises four diodes D101–D104 which feed a capacitor storage element C101. A capacitor C103 and diode D106 form a low-energy boost (i.e. voltage doubler) circuit 110A during the negative half-cycle and capacitor C102 and diode D105 form a low energy boost circuit 110B during the positive half-cycle. The boost circuits 110A, 110B produce half-cycle voltage pulses thus providing the OCV required for starting the lamp 500.

The resistor R101 is a bleeder resistor for the storage discharge capacitor C101 when the circuit is switched off or disconnected from the AC power source. The capacitor C101 may retain charge for up to several weeks. The resistor R101 enables the capacitor C101 to discharge to a safe value within a short time after power is removed so that an unknowing user does not receive an electrical shock from the charges capacitor. Optimally, the resistor R101 is sized with the capacitor C101 to discharge the capacitor C101 to less than 48 volts in a relatively short time, for example, about 15 seconds.

The filament R304 illuminates during lamp startup to provide immediate light while an arc is established in the lamp 500. The immediate light filament R304 may also be energized during periods when power is available to the circuit 10 but the lamp 500 is extinguished, such as following lamp failure or during a "hot restart" following a brief power interruption.

Illumination of the immediate light filament R304 is controlled by the immediate light control circuit 300. A triac Q301 is gated to provide current to the filament R304 when the circuit 300 senses that the lamp 500 is not illuminated, i.e. no current is flowing through the lamp 500. The diode D302, the resistors R301, R302, R303 and sidac Q302 operate to control the triac Q301. The capacitors C302 and C303 provide noise filtering. The capacitor C301 provides a time delay so that current is provided to the filament R304 for a period of time following the establishment of current through the lamp 500 thus providing auxiliary illumination until the lamp 500 is at full brightness.

Prior to establishing an arc in the lamp 500, the full voltage appears across the terminals of the lamp 500. The voltage feeds into the diode D302 and the resistor R303 causing the sidac Q302 to become conductive. The capacitor C301 charges causing a bias current to flow through the resistor R302 to gate on the triac Q301. When the triac Q301 is gated on, current flows through the filament R304 thus illuminating the filament during both half-cycles of the AC power.

When an arc is established in the lamp 500, the voltage across the lamp initially drops to approximately 20 volts causing the sidac Q302 to become non-conductive. The capacitor C301 discharges through the resistors R302 and R301 causing the triac Q301 to become non-conductive thus preventing current from passing through the filament R304. Thus the filament R304 is no longer illuminated. As the temperature of the lamp 500 rises, the voltage across the lamp rises to about a range of 75–90 volts, but remains below the breakover voltage of the sidac Q302. Thus the triac Q301 remains non-conductive and the filament R304 remains dark.

The lamp circuit 10 includes a relaxation-type starter circuit which produces the high voltage to initially break down the lamp 500 during lamp startup. The starter circuit 200 includes a capacitor C201 with a first terminal tapped off a third terminal on the transformer T201. The second terminal of the capacitor C201 is connected to a node D. A sidac Q201 is connected at a first terminal to a node BF and at a second terminal thereof to the node D. A resistor R201 is connected at a first terminal to the node D and at the second terminal thereof to a node C. A capacitor C202 is connected at a first terminal to the node BF, and at the second terminal thereof to the node C. The capacitor C202 acts as a filter to attenuate the EMI generated by the igniter circuit 200.

During startup of the lamp 500, the capacitor C201 charges as current flows through the resistor R201. When the voltage across the capacitor C201 exceeds the breakover voltage of the sidac Q201, the sidac switches from a non-conducting to conducting state, causing the capacitor C201 to discharge through the tapped portion of the winding of transformer T201. The transformer winding from the node BF to the tap comprises the primary winding of an autotransformer configuration. The current discharge through the transformer winding generates a high voltage pulse across the winding of the transformer T201 from the node BF to the node H. The capacitor C202 forms a low-impedance path for the first terminal of the transformer T201 relative to the node C, thereby causing the high voltage pulse to appear in its entirety at the first terminal of the lamp 500 relative to the circuit reference node C. The high voltage pulse causes the initial breakdown of the lamp 500.

The transformer T201 does not follow the conventional step-up ratio that applies to sinusoidal waveforms in the derivation of the conventional autotransformer. The transformer T201 operates similar to a tapped inductor having an inductance "L", wherein the voltage "V" developed across the inductor is equal to (L)di/dt, where di/dt is the rate of change of current. The rate of change of current depends upon the rate of build-up and collapse of the magnetic field produced by the discharge of the capacitor C201 via the sidac Q201, which is limited by many factors including the internal resistance of the sidac Q201.

After the initial breakdown in the lamp 500, the lamp 500 proceeds through the glow-to-arc transition stage to a steady state run mode. The voltage across the capacitor C101 is equal to the peak of the line voltage, i.e. approximately 170 volts DC which is less than the OCV required to effect the glow-to-arc transition in the lamp 500. However, the boost circuits 110A, 110B provide the additional voltage to attain the required OCV for the lamp to effect the transition.

In operation, the diode D106 causes the capacitor C103 to charge further negative by an additional 170 Volts and the diode D105 causes the capacitor C102 to charge further positive so that the voltage across the lamp 500 during a portion of each half-cycle is approximately 340 volts (i.e. high enough to effect glow-to-arc transition in the lamp). The capacitors C102 and C103 are sized to discharge sufficient stored energy into the lamp to initiate the arc. This discharge causes the terminal voltage of the lamp 500 to fall below the voltage across the capacitor C101 and thus is instantly followed up by the larger current available from the capacitor C101, whereupon the voltage and current from the capacitor C101 is sufficient to subsequently maintain the arc.

Once an arc is established and current flows through the lamp 500, the run circuit for the lamp 500 includes the four rectifier diodes D110–D104. The run current flows from the positive terminal of the capacitor C101 through the diode D105, the ballast filament R404, the starting transformer T201, and the lamp 500. The run current continues through the boost diode D106 to the negative terminal of capacitor C101. The run current is limited and held substantially constant by the resistance of the filament R404.

Figure 2:
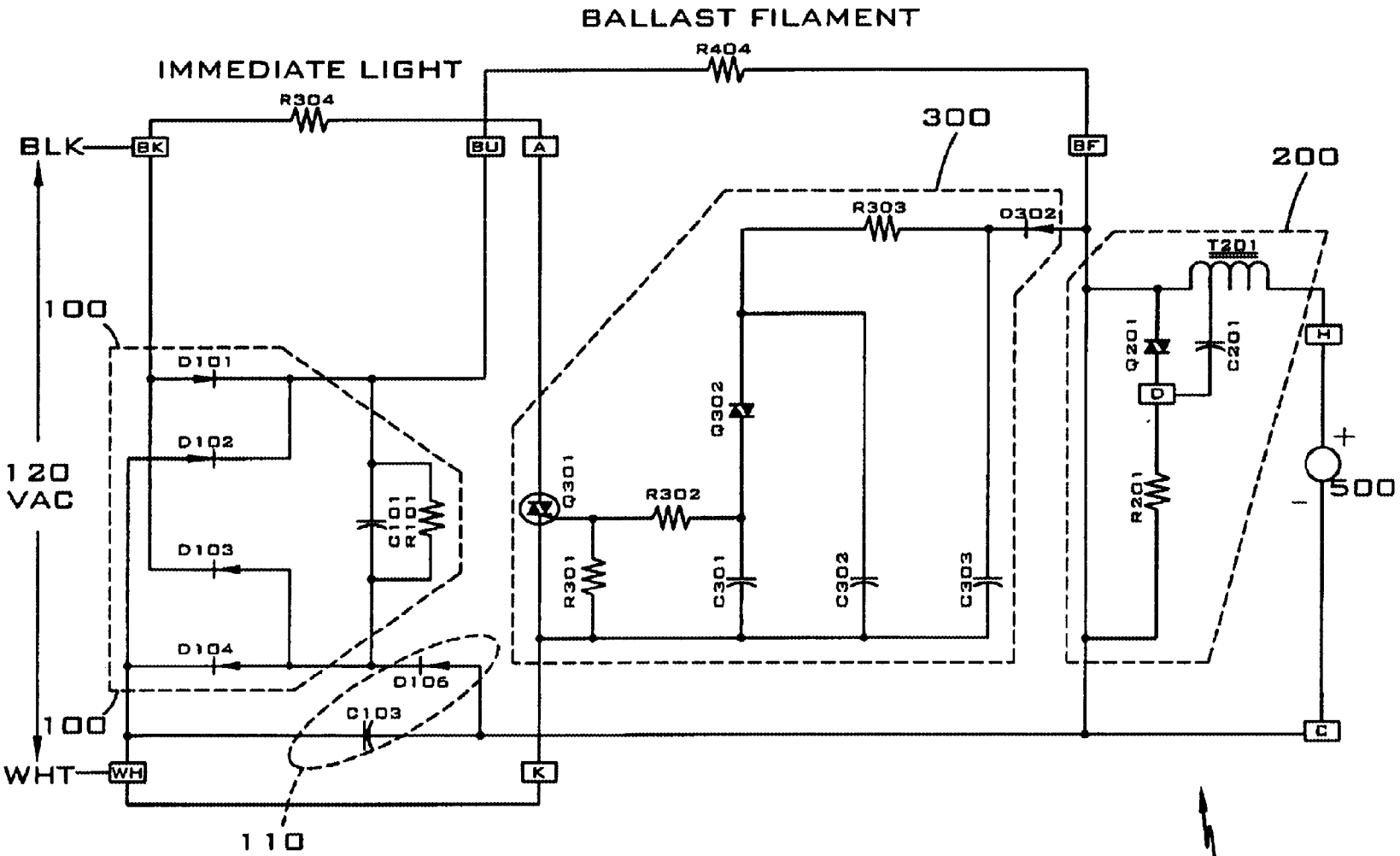
FIG. 2 is a schematic circuit diagram of another embodiment of a resistively ballasted metal halide arc discharge lamp circuit.

The boost voltage from only one of the boost circuits 110A,110B is sufficient to meet the OCV required for the lamp 500, thus either boost circuit 110A or boost circuit 110B may be removed from the operating circuit 10 and the circuit 10 will remain capable of starting and operating the lamp 500. FIG. 2 illustrates an embodiment of the circuit 10 wherein the boost circuit 110B comprising the capacitor C102 and the diode D105 have been removed.

The size of the capacitor C101 is determined by the size of the lamp 500. For example, the lamp circuit 10 shown in FIGS. 1 and 2 including the capacitor C101 having a capacitance of approximately 220 uF may operate a lamp 500 of up to about 150 watts.

The filament R404 may be a 120 volt AC incandescent lamp typically having a rated wattage at twice the rated wattage of the lamp 500. Thus if the lamp 500 is rated at 150 watts, the filament R404 may be the lamp filament of a 120 volt AC incandescent lamp rated at 300 watts.

In a lamp operating circuit 10 as shown in FIGS. 1 and 2 operated from a 120 volt AC power source, the steady state DC voltage is around 170 volts DC. The lamp 500 may be designed to operate with a terminal voltage within a range as high as 75–90 volts or approximately one half of the steady state DC voltage. In the preferred embodiment of the present invention, the lamp 500 operates with a terminal voltage within the range of 65–75 volts.

Figure 3:
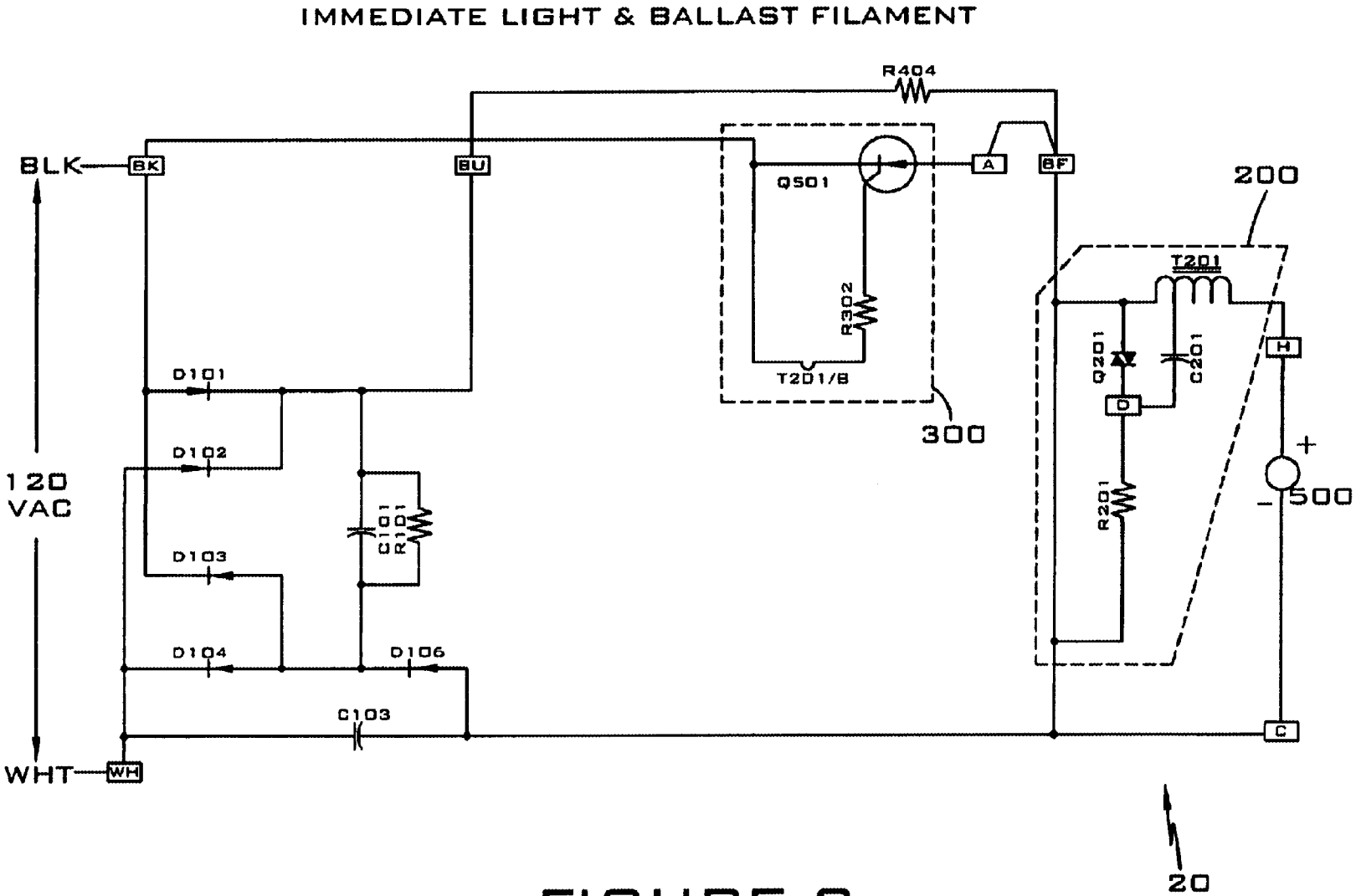
FIG. 3 is a schematic circuit diagram of one embodiment a resistively ballasted metal halide arc discharge lamp circuit according to the present invention wherein the ballast resistor functions as the immediate light filament.

FIG. 3 illustrates another embodiment of the present invention. In the operating circuit 20, the filament R404 provides both the ballasting resistance and illumination when power is available to the circuit 20 but an arc is not established in the lamp 500. During startup of the lamp 500, the filament R404 provides illumination. However, continuous illumination of the filament R404 during both half cycles would "steal" away voltage from the lamp 500 preventing an arc from being established in the lamp 500 during lamp startup. The SCR Q501 fires only during the negative half cycle of the AC input line cycle, so that on the positive AC line cycle, the filament R404 is bypassed so that voltage available from capacitor C103 is provided to start the lamp 500.

The illumination of the filament R404 when power is available to the circuit 20 but an arc is not established in the lamp 500 is controlled by the immediate light control circuit 300. The control circuit 300 includes a one-turn winding T201/B which is added to the transformer T201. With power available and no current passing through the lamp 500, pulses trigger the SCR Q501 so that current passing through diode D102 illuminates filament R404 during each negative half-cycle. The resistor R302 limits the current drawn from the winding T201 to prevent excessive current from being drawn which may dampen the discharge of the capacitor C201 and reduce the high voltage pulse required for initial breakdown of the lamp 500. When an arc is established in the lamp 500, the SCR Q501 is no longer pulsed and thus becomes non-conductive.

The circuit 20 illustrated in FIG. 3 also includes a modified starting circuit connection. The bottom end of resistor R201 and the capacitor C202 are connected to the negative terminal of the storage capacitor C101 as opposed to connecting to the higher negative voltage at the node C. Thus the voltage drop across the resistor R201 is reduced thereby reducing the power dissipation in the resistor R201 allowing the use of a less expensive component. The sidac Q201 is reduced to 130 volts in order to trigger from the 170 volts available across C101. In order to develop the required breakdown voltage, the transformer T201 in the circuit 20 must have more turns than the transformer T201 in the circuit 10 shown in FIGS. 1 and 2. For example, the transformer T201 which may be used with sidacs in the range of about 200 volts to about 240 volts includes approximately 80 turns, with a 4-turn primary winding. The transformer T201 which may be used with sidacs of about 130 volts includes approximately 120 turns.

As shown in FIG. 3, the starting circuit 200 operates in cooperation with the immediate light control circuit 300. In order for the immediate light control circuit 300 to be triggered during the negative half-cycle, the starter circuit 200 must be running even though the lamp 500 will not start because of power dissipation in the filament R404. The starting circuit 200 is connected across the main storage capacitor C101 and thus may be run during both half-cycles of the AC voltage supply from the filtered DC power.

Figure 4A:
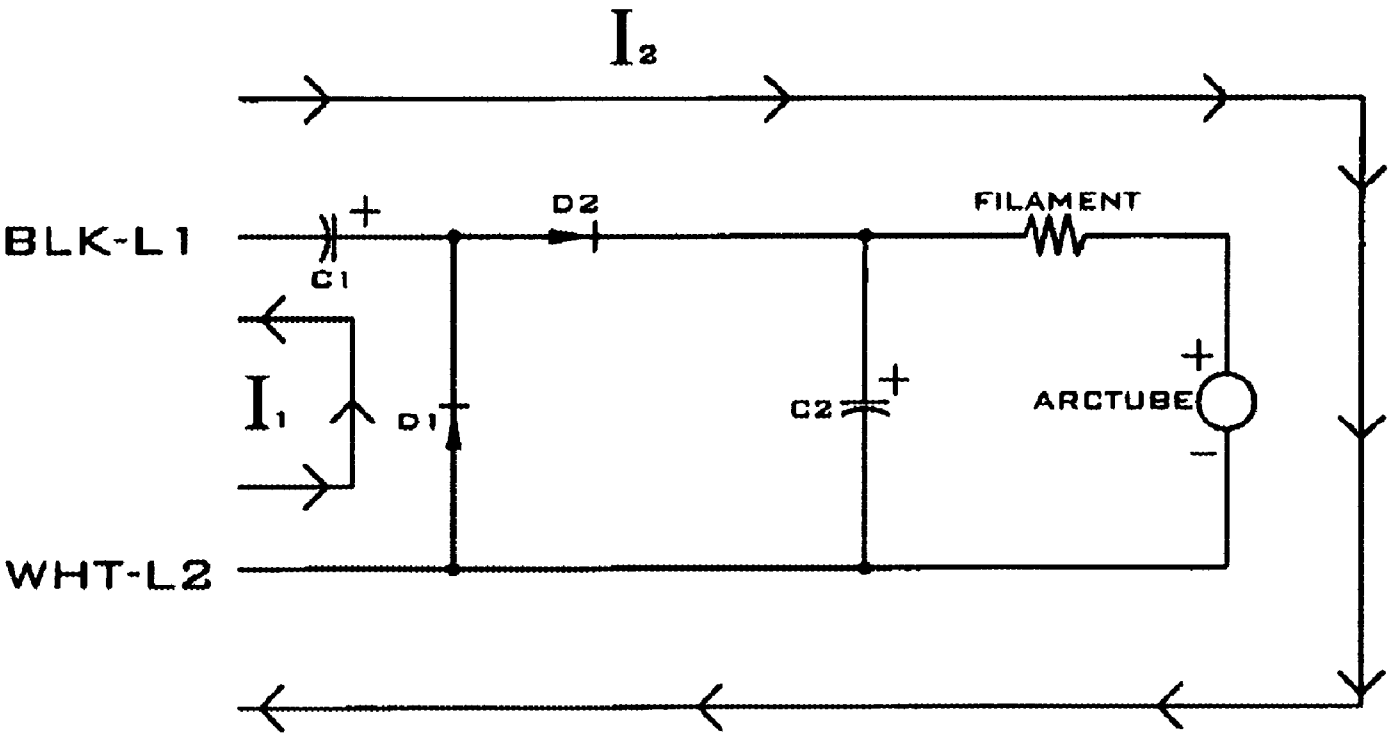
FIGURE 4A PRIOR ART
FIG. 4A is a schematic circuit diagram of a prior art circuit showing a conventional voltage doubler connected to a resistively ballasted metal halide lamp.

The present invention provides further economic advantages over the prior art by employing a voltage doubler circuit which includes only the components necessary to provide sufficient OCV for the lamp. FIG. 4A illustrates a typical voltage doubler circuit employed in prior art circuits. With reference to FIG. 4A, the negative half-cycle current I1 flows through diode D1 and charges the capacitor C2 to the peak value of the AC line voltage. For a nominal 120 volt AC line, the peak value is determined by multiplying the 120 volt RMS value by 1.414, yielding approximately 170 volts DC. When the line goes positive (L1 relative to L2), the voltage on the capacitor C1 "rides up" or adds to the line voltage. This causes current I2 to flow through diode D2 charging the capacitor C2 to a value of about two times the peak voltage. In this example, the capacitor charges to a value of about 340 volts DC. The voltage across capacitor C2 is maintained by selecting a sufficient value for capacitor C2 to produce a smooth output with low ripple.

When starting an arc discharge lamp, it is not necessary that the terminal voltage of the lamp be held constant, only that the terminal voltage exceed the OCV of the arc discharge lamp for a period of time sufficient to effect the glow-to-arc transition in the lamp. Therefore, the diode D2 and the capacitor C2 are not required in the voltage doubler circuit shown in FIG. 4A to effect arc discharge lamp startup.

Figure 4B:
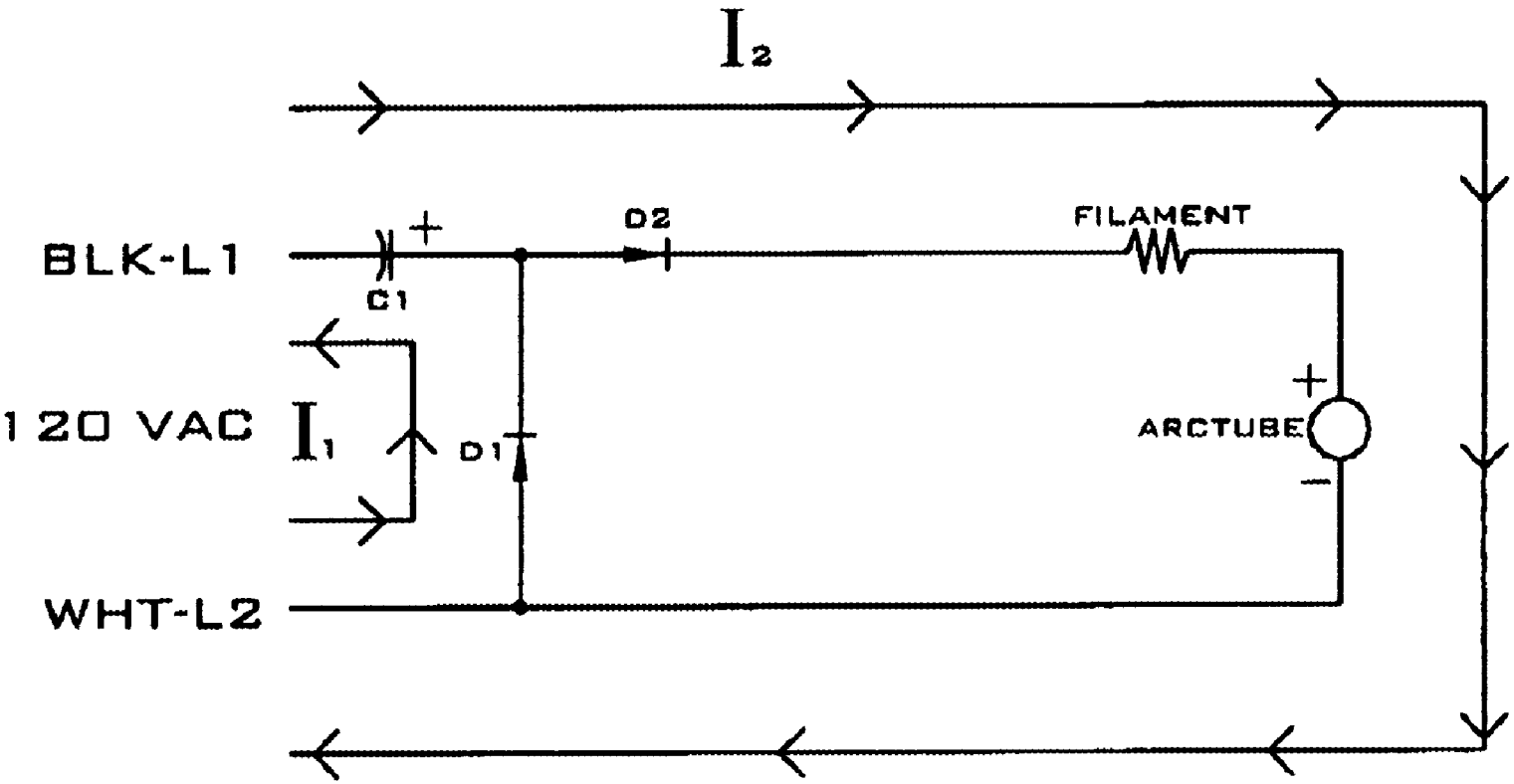
FIG. 4B is a schematic circuit diagram showing one embodiment of a voltage doubler for providing the OCV for a resistively ballasted metal halide lamp on the negative half-cycle.
Figure 4C:
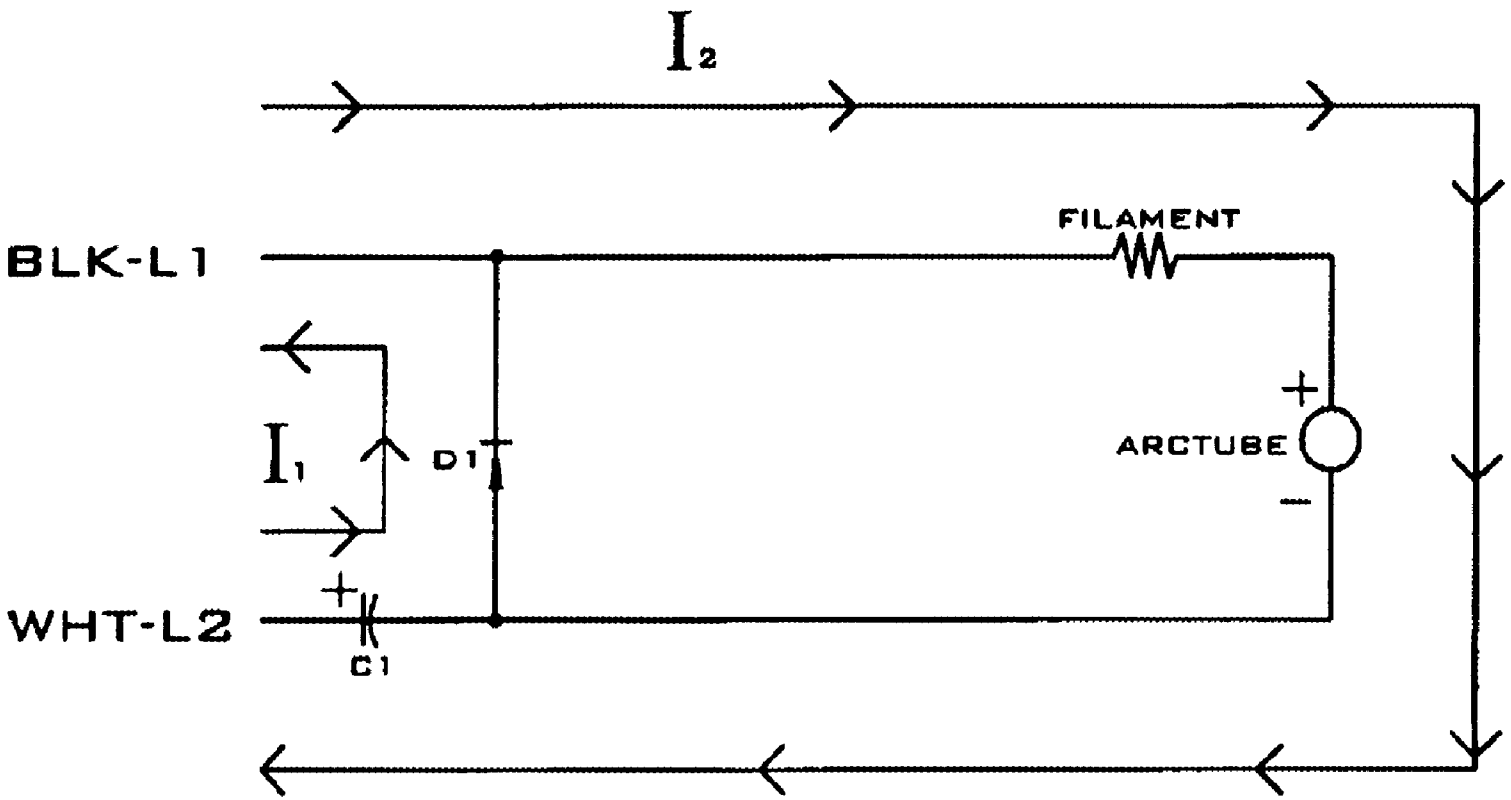
FIG. 4C is a schematic circuit diagram showing one embodiment of a voltage doubler for providing the OCV for a resistively ballasted metal halide lamp on the positive half-cycle.

FIGS. 4B and 4C each illustrate an embodiment of a voltage doubler circuit according to the present invention. With reference to FIG. 4B, the voltage potential across the capacitor C1 rises during the positive half-cycle of the AC line voltage resulting in a sinusoidal shaped half-wave with a maximum value of 340 volts. The typical arc discharge lamp operated from a 120 volts AC power source requires an OCV of about 215 volts to achieve glow-to-arc transition in the lamp. The transition may not occur within one half-cycle, but usually occurs after several successive half-cycles as a result of the repetition of the half-wave sinusoidal 340 volt pulse.

With reference to FIG. 4C, the voltage potential across the capacitor C1 rises during the negative half-cycle of the AC line voltage resulting in a sinusoidal shaped half-wave with a maximum value of 340 volts. This voltage potential is sufficient to effect a glow-to-arc transition within the arc discharge lamp usually after several successive pulses.

Figure 8:
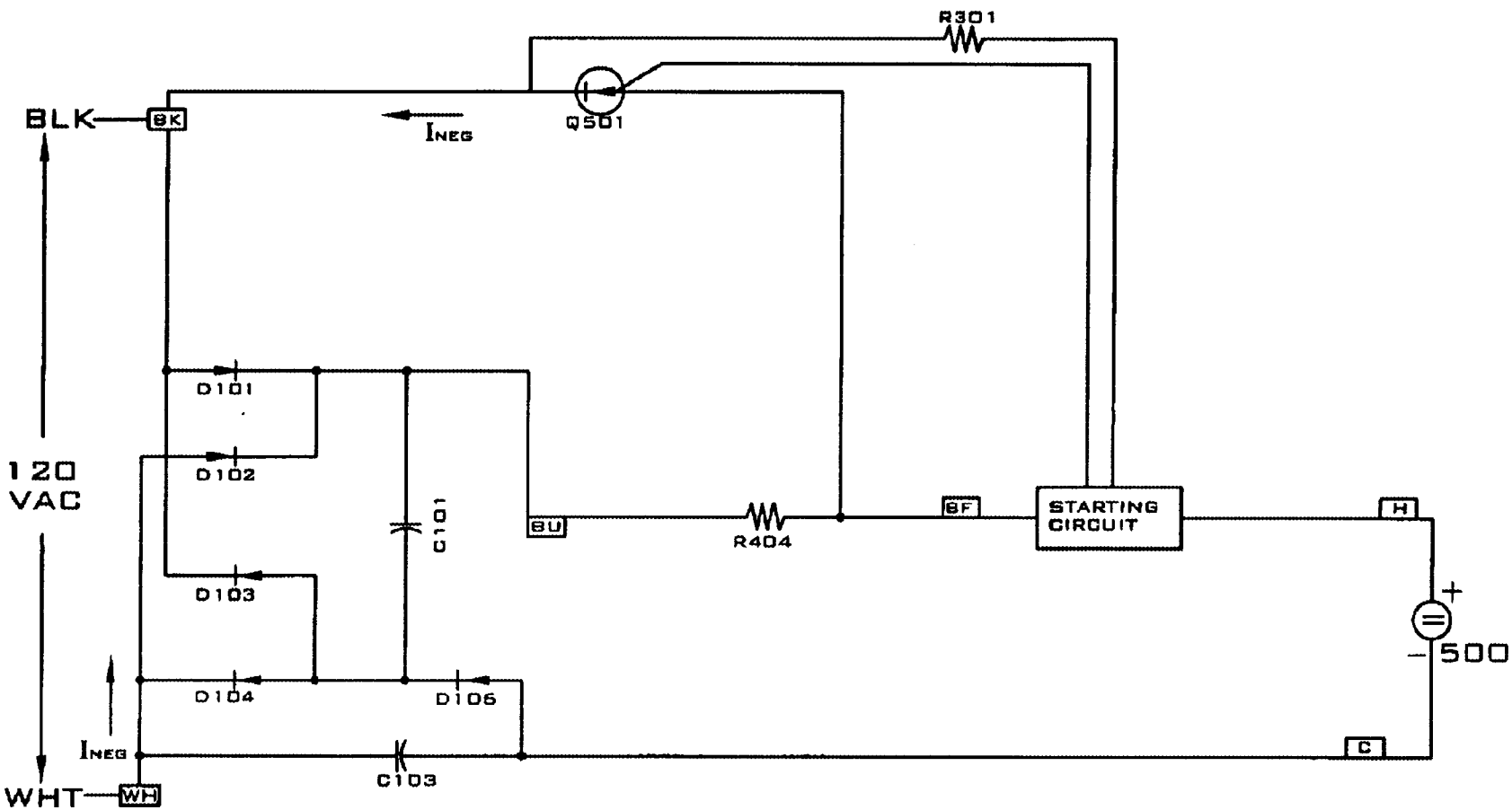
FIG. 8 is a circuit diagram of the circuit shown in FIG. 3 during the negative half cycle of the AC power supply prior to lamp startup.

FIG. 8 illustrates the operation of the circuit of FIG. 3 during the negative half-cycle of the 120 volt AC power supply. With reference to FIG. 8, and using the terminal WH, or neutral terminal, as a reference, when the voltage at terminal BK, or main side terminal, swings negative the capacitor C103 charges from the terminal WH through the diodes D106 and D103 back to the terminal BK so that the voltage at the node C follows the power line down to the maximum negative voltage of 170 volts. The capacitor C103 charges to a negative 170 volts at the node C. The capacitor C101 charges to positive 170 volts at the node BU. Thus a voltage potential of 340 volts appears across the series combination of the filament R404 and the arc lamp 500. During the negative half-cycle the SCR Q501 is ON and the voltage at the node BF is negative 170 volts, so that the filament R404 is illuminated with current flowing through the diode D102 to provide immediate light during startup of the lamp 500. The current drawn by the filament R404 prevents the startup of the lamp 500.

Figure 9:
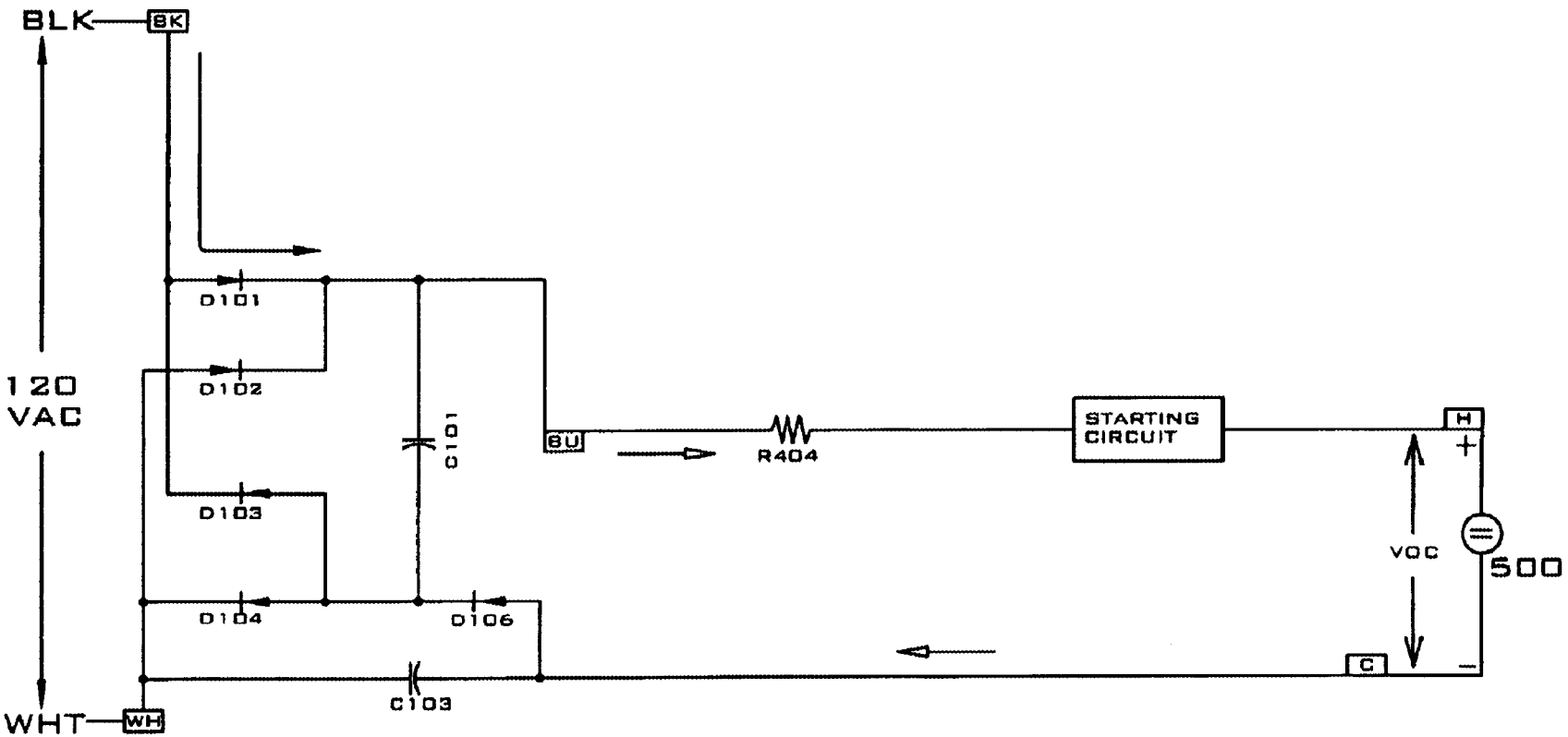
FIG. 9 is a simplified circuit diagram of the circuit shown in FIG. 3 during the positive half cycle of the AC power supply prior to lamp startup.

FIG. 9 illustrates the operation of the circuit of FIG. 3 during the negative half-cycle of the 120 volt AC power supply. With reference to FIG. 9, an arc is established in the lamp 500 during the positive half-cycle of the 120 volt AC power supply due to the the voltage potential across the lamp 500 created by the negatively charged capacitor C103.

Figure 10:
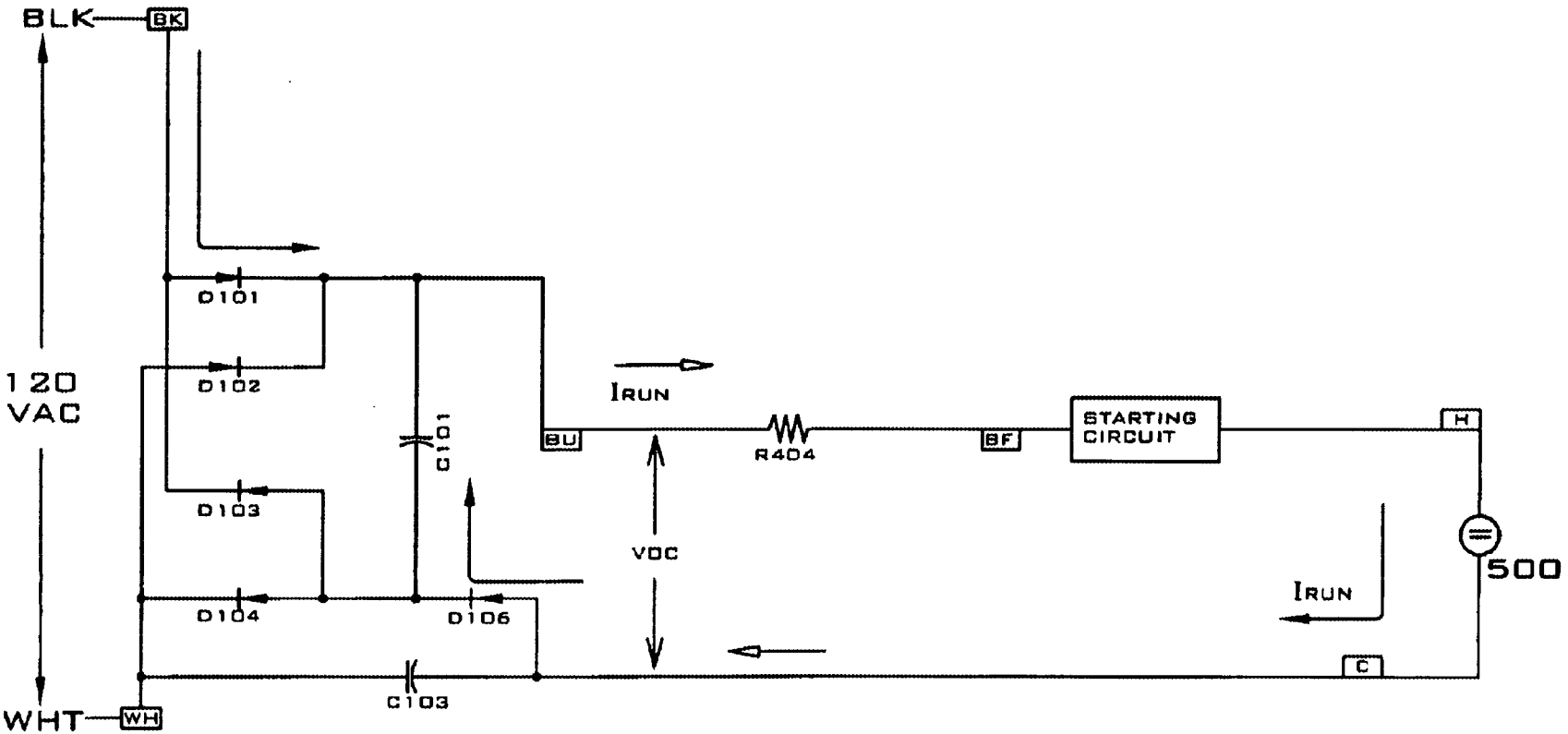
FIG. 10 is a simplified circuit diagram of the circuit shown in FIG. 3 during the steady state run mode.

FIG. 10 illustrates the operation of the circuit of FIG. 3 in the steady state run mode. When current flows through the lamp 500, the igniter circuit 200 stops pulsing and the SCR Q501 becomes non-conductive and is removed from the circuit. The full voltage across the storage capacitor C101 remains available to the lamp 500 on a continuous basis, i.e. it is no longer interrupted at half-cycle intervals by current dissipation in the filament R404 prior to current flowing through the lamp 500.

Figure 5:
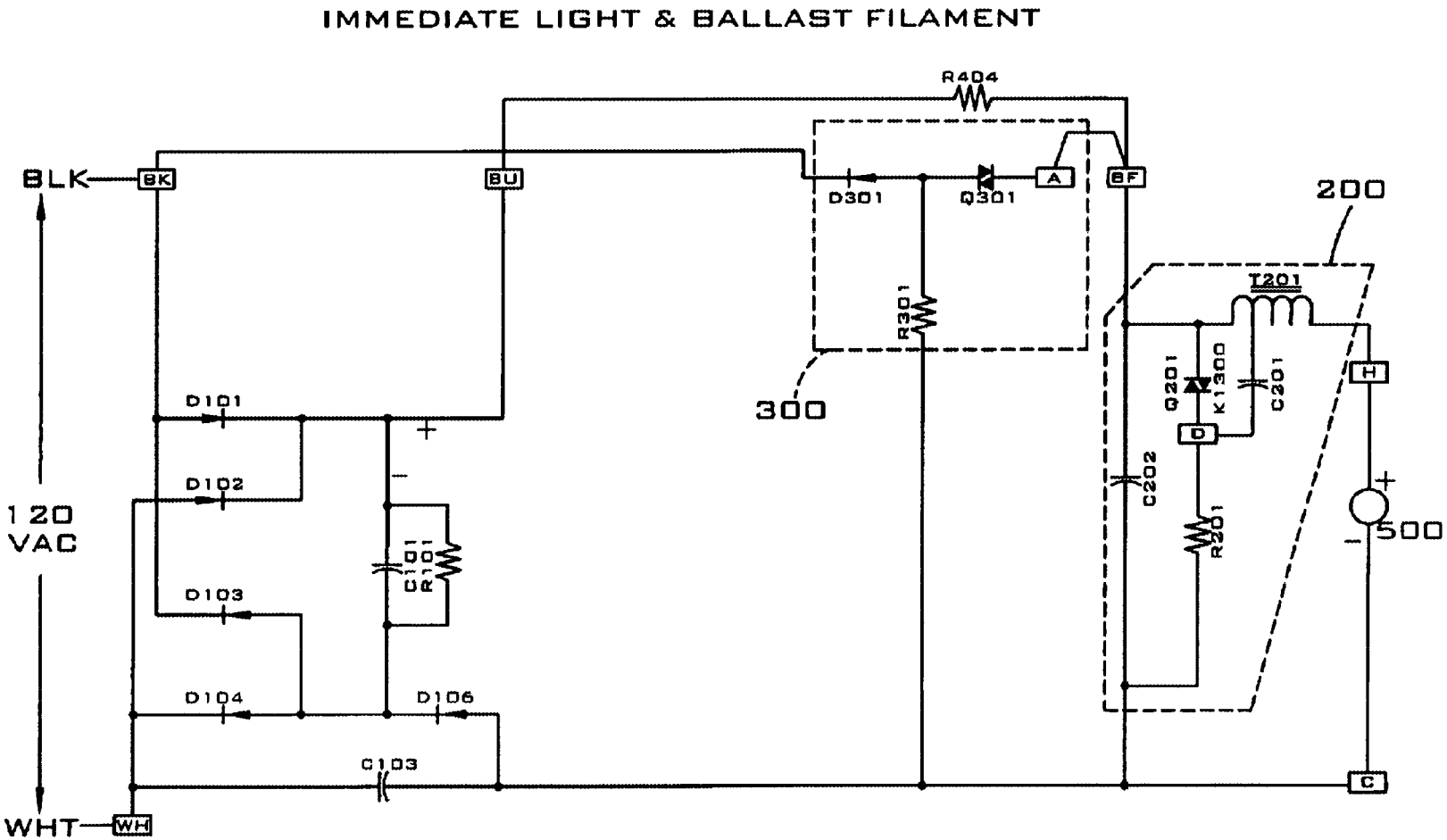
FIG. 5 is a schematic circuit diagram of one embodiment of a resistively ballasted metal halide arc discharge lamp circuit according to the present invention wherein the ballast resistor functions as the immediate light filament.

FIG. 5 illustrates an alternative embodiment of the intermediate light control circuit 300. The novel switching means used to illuminate the immediate light filament R404 eliminates the need for the extra single-turn winding T201/B on the transformer T201 as shown in FIG. 3. During the negative half-cycle of the 120 volt AC power supply, a current path is established from the terminal WH through the diode D102, through the filament R404, through the sidac Q301, and through the diode D301 to the terminal BK. A resistor R301 is connected at one end to the junction of the sidac Q301 and the diode D301, and at the other end to the junction of diode D106 and the capacitor C103. During the negative half-cycle the voltage at the terminal BK becomes negative, the voltage across the sidac Q301 exceeds its breakover voltage and the sidac Q301 becomes conductive for the remainder of the half-cycle. Thus the filament R404 is illuminated for the remainder of the half-cycle. The diode D301 prevents current from flowing directly from the terminal BK through the lamp 500 during the positive half-cycle without passing through a current limiting means, i.e. the filament R404. A DC bias across the sidac Q301 may be maintained by providing a current path from one end of the sidac Q301 to the terminal WH through resistor R301. The other end of the sidac Q301 is connected to the positive terminal BU through the filament R404. This arrangement ensures that the sidac Q301 will trigger predictably, and allows Q301 to trigger sooner in the negative half-cycle.

With further reference to the circuit of FIG. 5, the filament R404 illuminates at an RMS line voltage of about 90 volts and above. The lamp 500 will start and operate at an RMS line voltage of about 105 volts and above.

Figure 6:
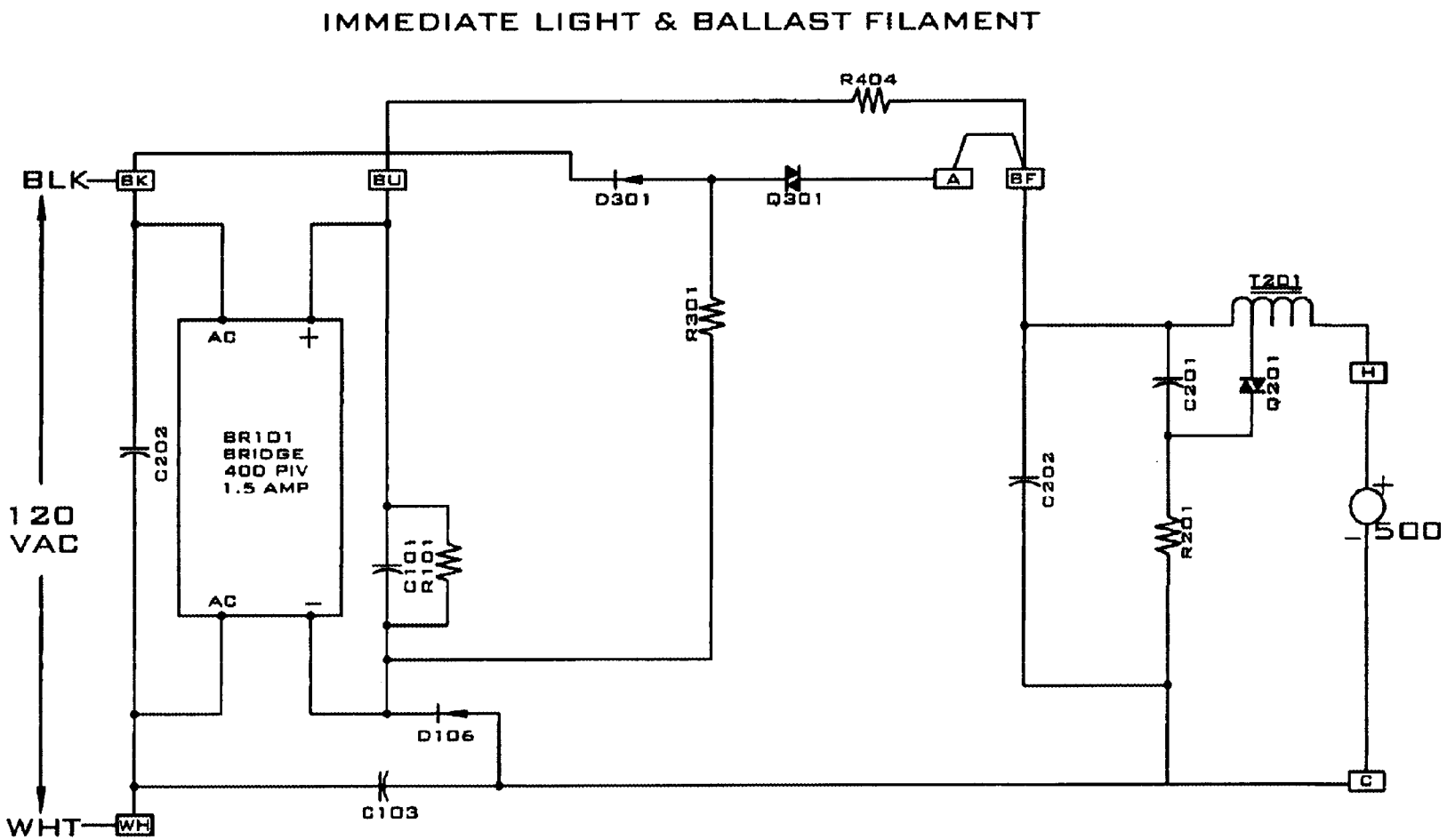
FIG. 6 is a schematic circuit diagram of one embodiment of a resistively ballasted metal halide arc discharge lamp circuit according to the present invention including a packaged bridge rectifier and voltage doubler for the positive half-cycle.

FIG. 6 illustrates yet another embodiment of the present invention. With reference to FIG. 6, the second terminal of the resistor R301 is connected to the negative terminal of the storage capacitor C101. Thus the voltage drop across the resistor R301 is reduced and therefore the power dissipation across the resistor R301 is reduced allowing the use of a less expensive component. In this embodiment, the filament R404 illuminates at an RMS line voltage of about 100 volts and above.

For the alternative immediate light control circuits 300 shown in FIGS. 5 and 6, once current flows through the lamp 500, a voltage drop occurs across the filament R404 and the voltage at the node A drops below the breakover voltage of the sidac Q301. The resistor R301 defines the voltage that appears across the sidac Q301 to ensure that the breakover voltage of the sidac Q301 is not exceeded so that the sidac Q301 remains nonconductive while current is flowing through the lamp 500.

FIG. 6 also illustrates that the individual diodes D101–D104 may be replaced with a common bridge rectifier assembly shown as bridge assembly BR101. The capacitor C202 provides a filter to attenuate the electromagnetic noise generated by the igniter circuit 200. Similarly, the capacitor C002 attenuates such noise and prevents the noise from interfering with the AC power line.

The circuit shown in FIG. 6 does not require operation of the transformer T201 during the negative half cycle to trigger the sidac Q301. Therefore, the igniter circuit 200 may employ a sidac Q201 having a higher breakover voltage in the range of about 200 to 340 volts. This reduces the number of turns required on the transformer T201 thereby reducing the cost.

The disclosed circuits provide for operation of a resistively ballasted DC arc lamp of a metal halide type from an AC power source having a peak rectified voltage below the OCV of the lamp. However, the present invention relates to the operation of all types of arc discharge lamps. Further, the various triggering methods described herein for the immediate light filament may also be used in other circuits operating DC arc lamps from higher AC power supply voltages and other AC frequencies including but not limited to 50 Hz to 400 Hz.

Figure 7:
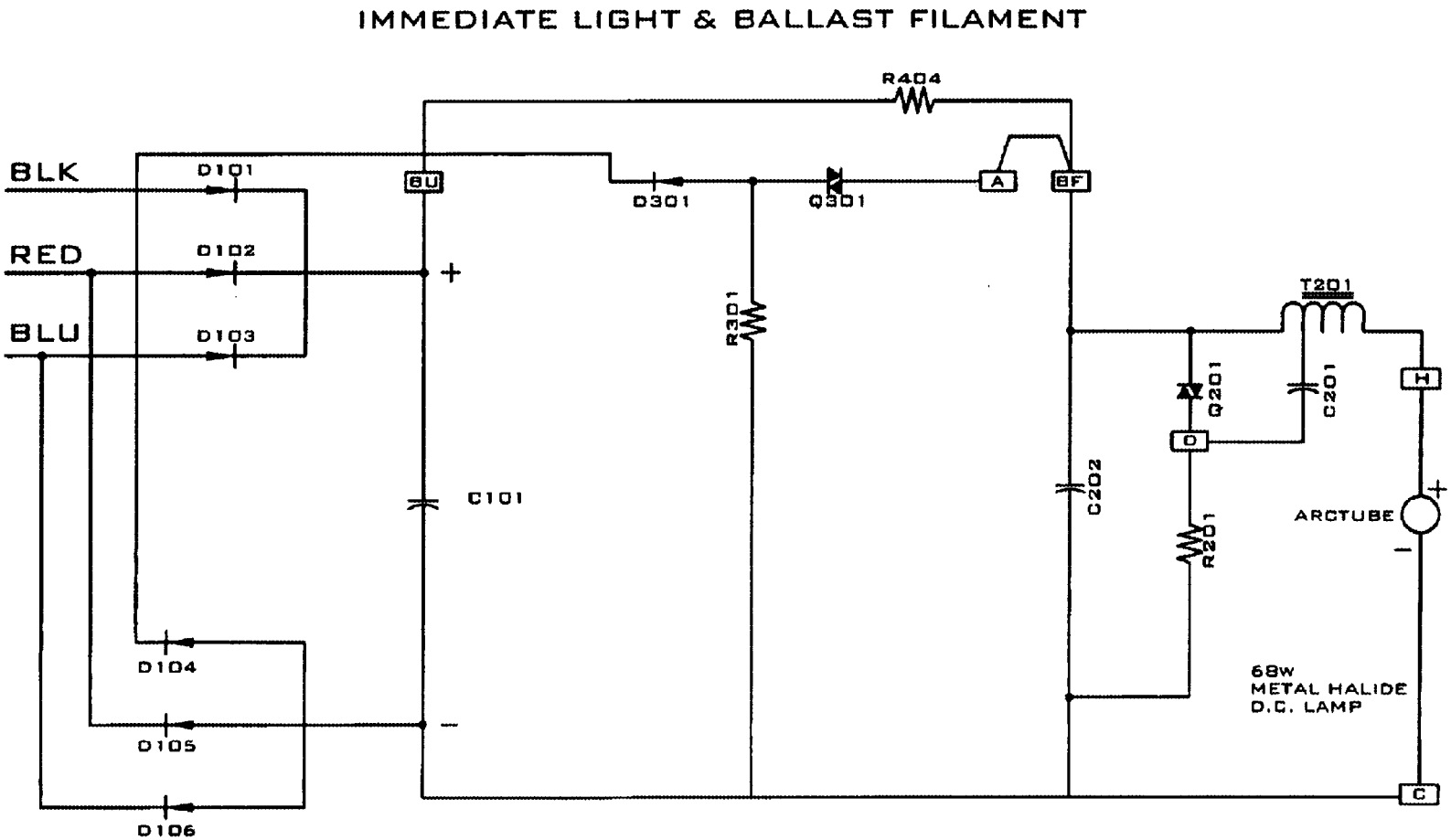
FIG. 7 is a schematic circuit diagram of a resistively ballasted metal halide arc discharge lamp circuit according to the present invention connected to a three phase AC power supply.

A resistively ballasted arc lamp may also be operated from a three-phase power line, as shown in FIG. 7. A three-phase, full-wave bridge rectifier configuration produces a ripple frequency six times the power line frequency. The waveform comprises three overlapping full-wave single-phase rectified waveforms offset by 120 degrees. The voltage remains greater than the voltage of the lamp and thus the storage capacitor C101 may be eliminated. A three-phase power supply is typically available at a line voltage of 208 volts which eliminates the need for an OCV boost circuit. FIG. 7 shows the basic circuit wherein the peak DC line voltage is about 265 volts DC for an input AC voltage of 208 volts AC. In such a circuit, a higher voltage sidac may be used with the advantage that the transformer T201 may include fewer turns.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A circuit comprising:

an arc discharge lamp;

an AC power source supplying an AC line voltage having a rectified peak voltage less than the voltage required to effect a glow-to-arc transition of the arc discharge lamp;

a full wave bridge rectifier for rectifying the AC line voltage into a DC voltage;

a voltage doubler for boosting the rectified voltage;

a storage capacitor connected across the bridge and capable of sustaining the rectified line voltage;

a current limiting filament connected in series with said lamp;

a switch device connected in series with said current limiting filament and in parallel with said arc discharge lamp;

a starter circuit that runs to break down said lamp; and a switch control circuit that closes said switch device when the starter circuit is running so that said filament is energized to provide immediate light prior to said lamp entering the normal run mode.

2. The circuit of claim 1 wherein said switch device comprises a triac.

3. The circuit of claim 1 wherein said switch device comprises an SCR.

4. The circuit of claim 1 wherein said switch control circuit includes a one-turn transformer.

5. The circuit of claim 1 wherein said switch control circuit closes said switch device for a predetermined time after an arc is established in said lamp to thereby provide a time delay between establishing an arc in said lamp and de-energizing the filament.

6. A circuit comprising:

an arc discharge lamp;

an AC power source supplying an AC line voltage having a rectified peak voltage less than the voltage required to effect a glow-to-arc transition of the arc discharge lamp;

full wave bridge rectifier for rectifying the AC line voltage into a DC voltage;

a storage capacitor connected across the bridge and being capable of sustaining the rectified line voltage;

a current limiting incandescent lamp filament connected in series with said arc discharge lamp; and a voltage doubler circuit for boosting the DC voltage to a voltage sufficient to effect the glow-to-arc transition in said arc discharge lamp, said voltage doubler comprising a diode connected between said rectifier and said arc discharge lamp and a doubler capacitor connected between said AC power source and said arc discharge lamp, said voltage doubler circuit isolating said storage capacitor from the voltage applied to the lamp.

7. The circuit of claim 6 further comprising an immediate light incandescent lamp filament for providing illumination during startup of the arc discharge lamp.

8. The circuit of claim 7 wherein said immediate light incandescent lamp filament is connected in parallel with said arc discharge lamp across said power source.

9. The circuit of claim 6 wherein said current limiting incandescent lamp filament provides illumination during startup of said arc discharge lamp.

10. The circuit of claim 6 further comprising a switch device connected in series with said current limiting incandescent lamp filament, said switch operating to provide electrical current to said current limiting incandescent lamp filament during only the negative half-cycle of the AC line voltage when no current is flowing through said arc discharge lamp so that said filament provides illumination while establishing an arc in said arc discharge lamp.

11. The circuit of claim 10 wherein said switch device comprises an SCR.

12. A circuit comprising:

an arc discharge lamp;

an AC power source supplying an AC line voltage having a rectified peak voltage less than the voltage required to effect a glow-to-arc transition of the lamp;

a full wave bridge rectifier for rectifying the AC line voltage into a DC line voltage;

a storage capacitor connected across the bridge and being capable of sustaining the rectified DC line voltage;

a current limiting incandescent lamp filament connected in series with said arc discharge lamp;

an immediate light incandescent lamp filament connected in parallel with said arc discharge lamp across said power source; and a voltage doubler circuit comprising a diode connected between said rectifier and said arc discharge lamp and a capacitor connected between said AC power source and arc discharge said lamp.

13. In a circuit comprising an arc discharge lamp connected in series with a current-limiting filament across an AC power source supplying an AC line voltage to a rectifier that produces a DC line voltage less than the voltage required to establish an arc condition in said lamp, the improvement comprising:

a voltage doubler circuit including a diode connected between said rectifier and said arc discharge lamp and a capacitor connected between said AC power source and said arc discharge lamp, said doubler circuit boosting said line voltage to thereby establish an arc condition in said lamp by effecting a glow-to-arc transition of said lamp.

14. The circuit of claim 13 further comprising a switch device connected in series with said current limiting filament across the AC power supply and connected in parallel with the arc discharge lamp, said switch device operating in conductive state during the negative half-cycle of the AC line voltage when no current is flowing through the arc discharge lamp to thereby effect illumination of said filament, said switch device operating in a non-conductive state during the positive half-cycle of the AC line voltage.

15. In a circuit comprising an arc discharge lamp connected in series with a current-limiting incandescent lamp filament across an AC power source supplying an AC line voltage, the improvement comprising:

a switch device connected in series with said current limiting filament across the AC power supply and connected in parallel with the arc discharge lamp, said switch device operating in conductive state during the negative half-cycle of the AC line voltage when no current is flowing through the arc discharge lamp to thereby effect illumination of said filament, said switch device operating in a non-conductive state during the positive half-cycle of the AC line voltage.

16. The circuit of claim 15 wherein said switch device comprises a sidac.

17. The circuit of claim 15 wherein said switch device comprises an SCR.

18. A circuit comprising an arc discharge lamp connected in series with a current-limiting ballast powered by a three phase AC power source, the circuit comprising:

a full wave bridge rectifier for rectifying the power source and supplying DC line voltage and current to power the lamp, the DC voltage being greater than the voltage required to establish an arc condition in said lamp and the DC current being sufficiently stable so that said circuit does not include a storage capacitor.

19. A method of operating an arc discharge lamp comprising the steps of:

(a) providing an arc discharge lamp;

(b) providing an AC power source that supplies an AC line voltage;

(c) rectifying the AC line voltage using a bridge circuit to provide a DC line voltage less than the voltage required to effect a glow-to-arc transition in the arc discharge lamp;

(d) illuminating an immediate light incandescent lamp filament when the AC line voltage is present and no current is flowing through the arc discharge lamp;

(e) igniting the arc discharge lamp by applying a breakdown voltage to the lamp;

(f) boosting the DC line voltage to effect the glow-to-arc transition in the arc discharge lamp by using a voltage doubler circuit comprising a capacitor connected between a termination of the AC power source and the arc discharge lamp and a diode connected between the arc discharge lamp and the bridge circuit; and (g) running the arc discharge lamp in the steady state mode from the unboosted DC line voltage.

20. In a method of operating an arc discharge lamp including the steps of providing a rectified DC line voltage less than the voltage required to effect glow-to-arc transition of the lamp; igniting the lamp by applying a breakdown voltage to the lamp; energizing an immediate light filament prior to running the lamp in a steady state mode; boosting the DC line voltage to cause the lamp to pas through the glow-to-arc transition mode; and running the lamp in a stead state mode, the improvement comprising the step of:

isolating the storage capacitor from the boosted DC line voltage by providing a voltage boost circuit comprising a capacitor connected between a terminal of the power supply and the lamp and a diode connected between the lamp and the bridge circuit.

21. In a circuit comprising an arc discharge lamp connected in series with a current-limiting filament across an AC power source supplying an AC line voltage to a full wave bridge rectifier that produces a DC line voltage less than the voltage required to establish an arc condition in said lamp, the rectifier including a storage capacitor, the improvement comprising:

a voltage doubler circuit operable to isolate said storage capacitor from the voltage applied to the lamp to establish an arc condition.

22. The circuit of claim 21 further comprising a switch device connected in series with said current limiting filament across the AC power supply and connected in parallel with the arc discharge lamp, said switch device operating in conductive state during the negative half-cycle of the AC line voltage when no current is flowing through the arc discharge lamp to thereby effect illumination of said filament, said switch device operating in a non-conductive state during the positive half-cycle of the AC line voltage.

* * * * *